US006315401B1

(12) United States Patent
Stellmach et al.

(10) Patent No.: US 6,315,401 B1
(45) Date of Patent: Nov. 13, 2001

(54) INK PRINTER WITH AT LEAST ONE EXCHANGEABLE TANK FOR INK TO BE SUPPLIED TO ONE OR MORE RESERVOIRS

(75) Inventors: Dieter Stellmach, Bad Dürrheim; Timoth Hermann, Illerberg-Thal, both of (DE)

(73) Assignee: Tally Computerdrucker GmbH, Ulm-Elchingen (DE)

( * ) Notice: Subject to any disclaimer, the term of this patent is extended or adjusted under 35 U.S.C. 154(b) by 0 days.

(21) Appl. No.: 09/271,829

(22) Filed: Mar. 18, 1999

(30) Foreign Application Priority Data

Mar. 18, 1998 (DE) ..... 198 11 652

(51) Int. Cl.[7] ..... B41J 2/17
(52) U.S. Cl. ..... 347/84
(58) Field of Search ..... 347/84, 85, 86, 347/87, 49, 50

(56) References Cited

U.S. PATENT DOCUMENTS 4,709,245 11/1987 Piatt .
5,534,899 * 7/1996 Uchikata et al. ..... 347/49
5,691,753 * 11/1997 Hilton ..... 347/85

FOREIGN PATENT DOCUMENTS 379 151 7/1990 (EP) ..... B41J/2/005
478 244 4/1992 (EP) .
674 997 10/1995 (EP) .
872 355 10/1998 (EP) ..... B41J/25/34
2 316 657 3/1998 (GB) ..... B41J/2/175

* cited by examiner

*Primary Examiner*—Judy Nguyen
(74) *Attorney, Agent, or Firm*—Cohen, Pontani, Lieberman & Pavane

(57) ABSTRACT

An ink printer having a printer body having two side walls arranged at a longitudinal distance from one another and a user side as defined along a longitudinal side of the printer body between the two side walls, the printer body defining a reservoir within the printer body. An exchangeable tank is removably insertable into the printer body so as to supply ink to the reservoir. A printer ink connection is arranged at the printer body, an ink connection arranged at a side of the exchangeable tank, the tank side having a defined cross-section, the printer ink connection and the tank ink connection being arranged so as to be connectable to one another after insertion of the exchangeable tank into the printer body. A basin-type transverse carrier arranged longitudinally between the two side walls proximal the user side, the basin-type transverse carrier having an open top portion that accommodates the at least one exchangeable tank. A spring-mounted protective plate arranged in and perpendicular to the basin-type transverse carrier so as to be longitudinally movable, a cross-section of the at least one spring-mounted protective plate being configured so as to conform to and thereby accommodate the cross-section of the ink connection side of the exchangeable tank. Finally, a forward motion device arranged in the basin-type transverse carrier so as to enable manual movement of the at least one exchangeable tank into a fixed end position, thereby connecting the at least one printer ink connection to the tank ink connection.

14 Claims, 4 Drawing Sheets

Section X-X
Section X-X
Section X-X
X
X
X
X
4
4c
25
33
24
19
29
30
31
32

INK PRINTER WITH AT LEAST ONE EXCHANGEABLE TANK FOR INK TO BE SUPPLIED TO ONE OR MORE RESERVOIRS

BACKGROUND OF THE INVENTION

1. Field of the Invention

The present invention relates to an ink printer, and in particular an ink printer with at least one exchangeable tank for ink to be supplied to one or more reservoirs. An ink connection is provided on both a printer frame and the exchangeable tank, the two ink connections being connectable to each other after insertion of the exchangeable tank.

The exchangeable tank contains a plastic ink bag in an exchangeable tank housing. The plastic ink bag is purchased as a unit with the exchangeable tank housing, which is made of cardboard or plastic, and is exchanged as a unit by a user of the ink printer. During such exchanges, no ink emerges from the exchangeable tank, nor does the ink printer become contaminated at a transition point.

2. Description of the Related Art

Ink cartridges are known (DE 197 35 157) that do not meet the preconditions for simple exchange by the user. Nor do they have the desired large ink volume.

SUMMARY OF THE INVENTION

An object of the present invention is to provide an ink printer having an exchangeable large-volume tank ink reservoir. The present invention advantageously enables removing the exchangeable large-volume tank by simple manipulation on the part of the user, replacing the tank with a full exchangeable tank, and establishing an ink connection between a printer body and the exchangeable tank in a problem-free manner.

According to the present invention, the printer body has side walls, and on a user side of the printer body, a basin-type transverse carrier open at the top is arranged between the side walls, in which a spring-mounted protective plate is provided to accommodate one or more exchangeable tanks. An ink connection is provided at a side of each of the exchangeable tanks, the tanks being matched in cross-section on the sides having the respective ink connections. Furthermore, a forward motion device enables the exchangeable tank to be manually moved forward into and fixed in an end position so as to effect the connection to the ink connection.

As a result of the above features of the present invention, a user cannot incorrectly place the exchangeable tank in the transverse carrier. Moreover, the user can only move the exchangeable tank toward the ink connection in keeping with existing functions, thereby establishing the ink connection, so that the ink printer is ready for operation.

In another embodiment of the present invention, to eliminate the danger of injury, a shield plate is provided in an area of a spring-mounted protective plate, as the ink connections, that covers the transverse carrier at the top. A hollow needle is securely attached to the shield plate centrally relative to the ink connection of the exchangeable tank and is attached via a connecting line to a similarly attached pump.

The external appearance of an ink printer housing has a smooth outer form by virtue of the fact that the spring-mounted protective plate, in its external form, is movable via the shield plate with the hollow needle as a protective cover.

In a further embodiment of the present invention, two guide rods on which compression springs are arranged, are provided so as to mount and guide the spring-mounted protective plate.

In a further embodiment of the needle unit of the present invention, a component group is comprised of a pump plate, the pump, the hollow needle, the protective plate movable longitudinally against a spring force, and the shield plate. The protective plate has an opening through which the hollow needle penetrates into a valve of an adjacent exchangeable tank. In this way the protective plate protects against injuries from the hollow needle.

With respect to assembly technology, in still a further advantageous embodiment of the present invention, the component group with the spring-mounted protective plate and the shield plate is expandable by the connecting line to the pump.

In another embodiment, a bowl-like depression, which is slightly larger than a part of an exchangeable tank valve that projects from the exchangeable tank housing, is configured at a front face of the protective plate facing the exchangeable tank. Therefore, a compact assembly is achieved, without forming a large gap between the needle unit and the exchangeable tank.

In yet another embodiment, the forward-motion device is a longitudinally movable cam plate run in the transverse carrier with a hand lever attached from the outside to a journal. Pivoting the hand lever causes a forward movement of the cam plate, thereby moving the exchangeable tank toward the needle unit. Each exchangeable tank has associated with it such a cam plate, which, like the printer housing, is made of plastic, without great expenditure in weight or material being required.

In still yet a further advantageous embodiment, the cam plate has, at a right angle to the longitudinal direction, a slot-like link, into which the journal of the hand lever engages. The end position of the exchangeable tank or cam plate is ensured because, in a closed position of the hand lever, the center of the journal and the rotational angle of the hand lever lie in a line along the longitudinal direction of the cam plate.

Moreover, in still another embodiment, a rib, projection or the like, is arranged on the cam plate so as to engage into a corresponding recess in the exchangeable tank housing. A connection advantageous for the forward motion of the exchangeable tank into the desired end position is thereby effected.

In a further embodiment of the present invention, the hand lever, at its grip end, has a cross-piece with a slanted covering part, which, in the closed position of the hand lever, extends over the exchangeable tank housing. The reached end position is therefore further secured and, at the same time, made visible.

It is envisioned to have various embodiments of a driving gear in the present invention. In one embodiment, the corresponding recess in the exchangeable tank housing has, on a longitudinal edge, an approximately L-shaped recess, into which the rib, projection or the like of the cam plate engages.

In a different embodiment, the exchangeable tank has, on a longitudinal edge located in the transverse carrier, a first straight indentation running at a right angle to the longitudinal edge, as well as a second angular indentation running parallel to the first indentation. Upon the action of an external force, an angularly folded-in recess is, upon insertion of the exchangeable tank, pressed inward and folded inward by the cam of the cam plate. As a result, the exchangeable tank is producable from light-weight cardboard that, together with its contents, can be disposed of without problems.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the following drawings, wherein like reference numerals denote like elements throughout the drawings.

DETAILED DESCRIPTION OF THE PREFERRED EMBODIMENTS

Figure 1:
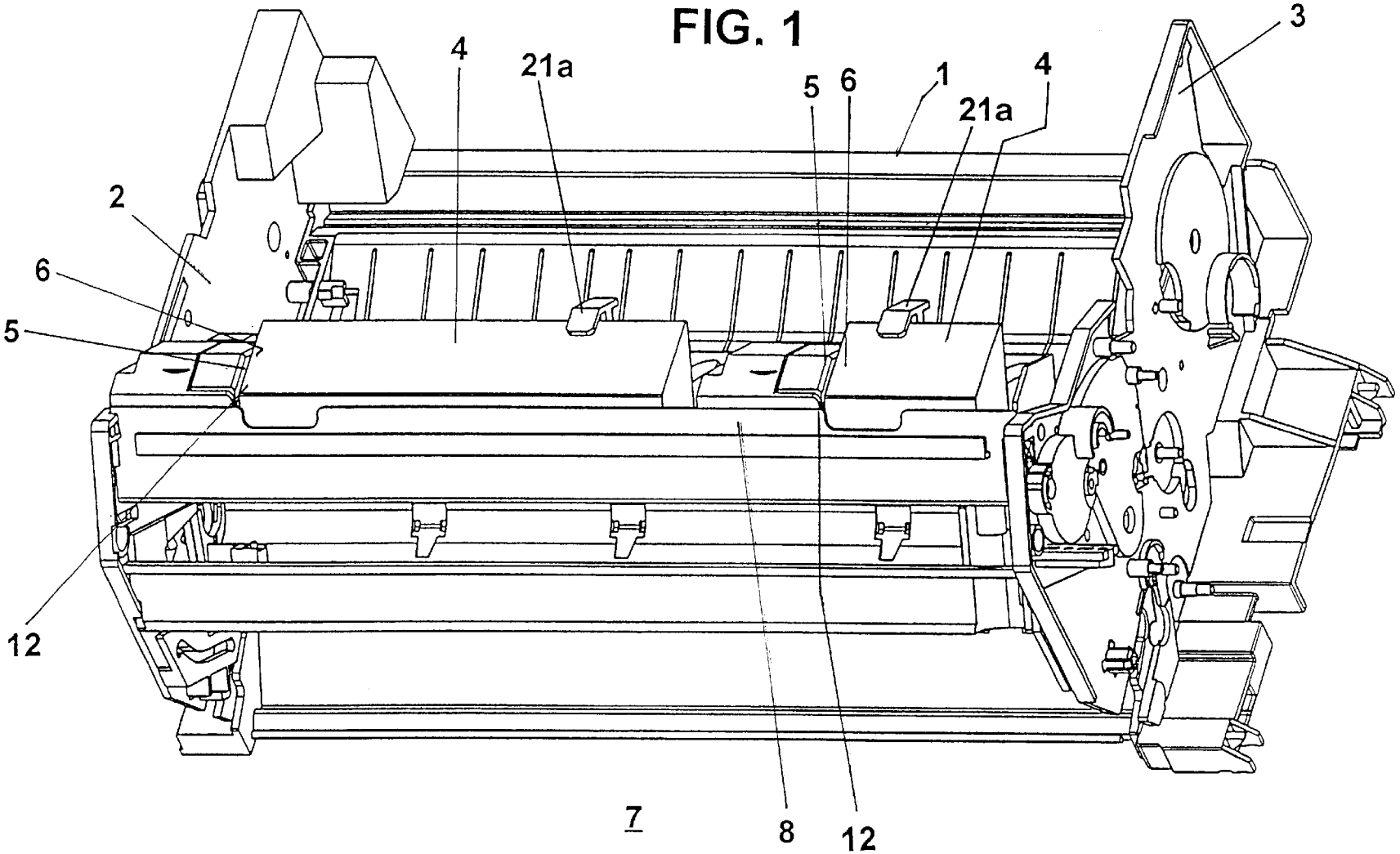
FIG. 1 is a frontal perspective view of a printer body of the present invention, shown with two inserted exchangeable tanks of different sizes and ink colors.

According to the present invention, as shown in FIG. 1, an ink printer includes a printer body 1 with side walls 2, 3. A transverse carrier 8 is longitudinally arranged proximal to a user side 7 of the printer body 1 between and perpendicular to the side walls 2, 3. At least one polygonal exchangeable tank 4, for supplying ink to the ink printer, is insertable into the transverse carrier 8, the transverse carrier 8 being open on top so as to receive the exchangeable tank 4. An ink connection 5 is arranged in the printer frame 1 so as to be connectable to a corresponding ink connection 6 arranged on a side 9 of the exchangeable tank 4.

The exchangeable tank 4 includes an exchangeable tank housing 4*b* having an exchangeable tank cross-section 4*a* and exchangeable tank longitudinal edges 4*c*. A spring-mounted protective plate 10, is arranged at the ink connection side 9 of the exchangeable tank 4 so as to cover a needle unit for the purpose of avoiding injuries. A bowl-type depression 6*b* is configured in the protective plate 10. The ink connection 6 of the exchangeable tank 4 contains a valve 6*a* arranged so as to be engageable into the bowl-type depression 6*b* of the protective plate 10.

The transverse carrier 8 is preferably basin-shaped, so that, upon insertion of an exchangeable tank 4, due to the polygonal form of the latter, a set position is created. Furthermore, straight grooves 23 are longitudinally configured in the transverse carrier 8. A cam plate 19 is slideably engaged in the straight grooves 23 so as to be movable in a longitudinal direction 26.

A forward motion device 11 is provided for manually moving the exchangeable tank 4 into and fixing in a final position 12 that establishes the ink connections 5, 6.

Figure 2:
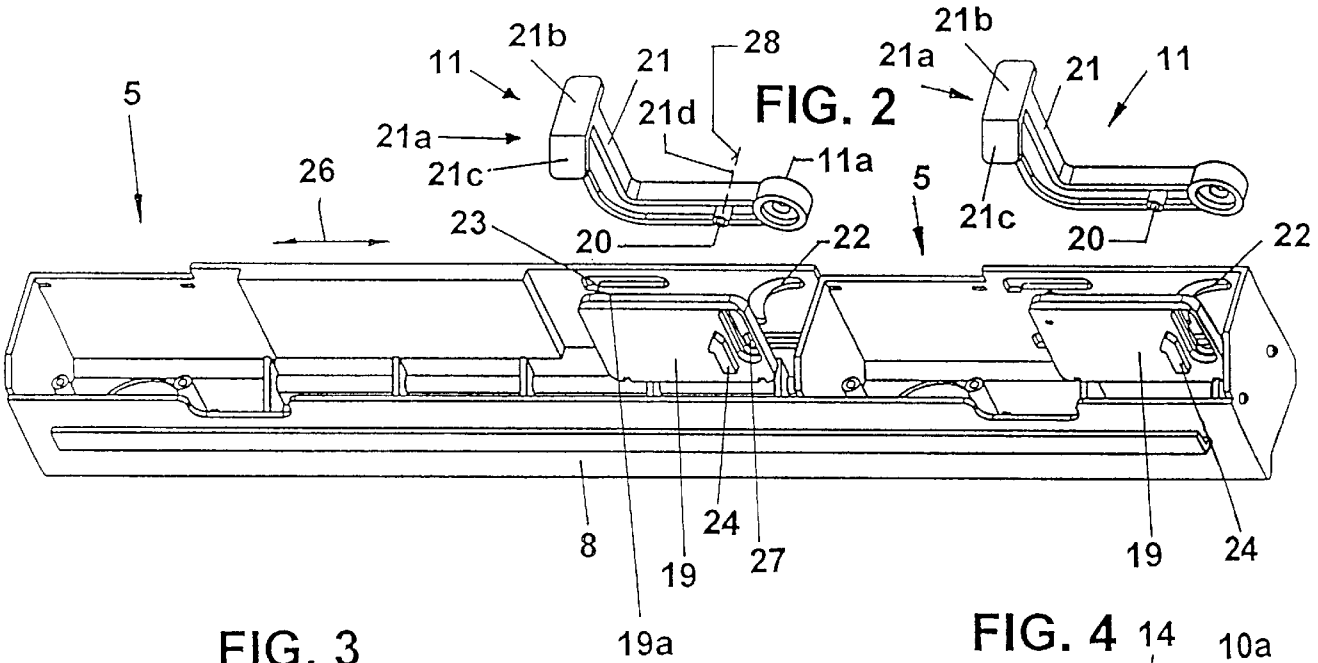
FIG. 2 is a perspective view of a transverse carrier, with a hand lever shown separately.

A link 27 arranged at the cam plate 19 extends perpendicular relative to the longitudinal direction 26, as shown in FIG. 2. A hand lever 21 having a journal 20 with a center 28 is mounted in the transverse carrier 8 about a rotational axis 11*a* so that the journal 20 engages the link 27. Pivoting of the hand lever 21 about the rotational axis 11*a* therefore moves the cam plate 19 in the longitudinal direction 26.

Figure 4:
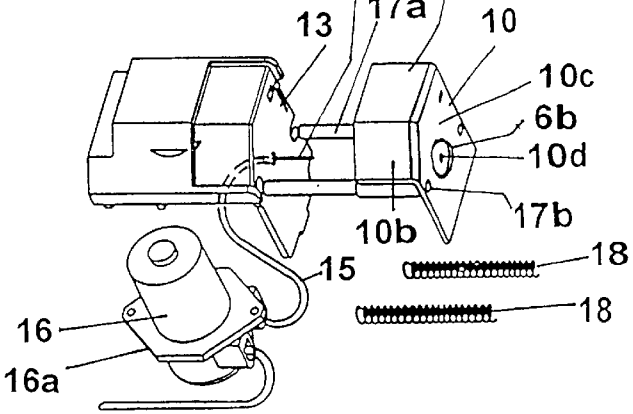
FIG. 4 is a perspective view of a needle unit with a protective plate, for the smaller one of the exchangeable tanks shown in FIG. 1.
Figure 3:
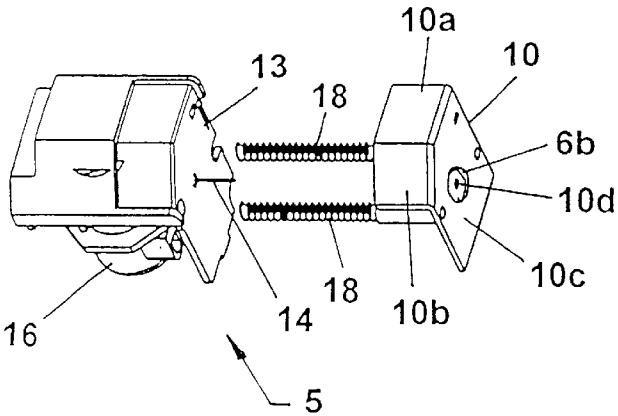
FIG. 3 is a perspective view of a needle unit with a protective plate, for the larger one of the exchangeable tanks shown in FIG. 1.

As shown in FIG. 3, the needle unit is represented by the ink connection 5. A shield plate 13 covers the transverse carrier 8 at the top in the area of the spring-mounted protective plate 10. A hollow needle 14 is securely attached in the shield plate 13, centrally relative to the ink connection 6 of the exchangeable tank 4. The needle 14 is secured via a connecting line 15 to a pump 16, which itself is attached to a pump plate 16*a*. An outer form 10*a* and a protective cover 10*b* are arranged on a side of the protective plate 10 facing the shield plate 13, the protective plate 10 being curved upward proximal the outer form 10*a* toward the protective cover 10*b*. A front face 10*c* of the protective plate 10 is configured away from the shield plate 13. An opening 10*d* is configured in the front face 10*c* for receiving the hollow needle 14. As shown in FIG. 4, guide rods 17*a* and 17*b* extend perpendicular to the shield plate 13. Compression springs 18 are positioned over the guide rods 17*a* and 17*b* so as to guide the front face 10*c* in a spring-mounted manner. The spring-mounted protective plate 10, with its outer form 10*a*, is moveable over the shield plate 13 with the hollow needle 14 to serve as the protective cover 10*b*, as shown in FIGS. 1 and 5.

The forward motion device 11 is configured as the cam plate 19, which is run and longitudinally movable in the transverse carrier 8, the hand lever 21 being secured from outside to the journal 20. A curved groove 22 is configured in the transverse carrier 8 so that the journal 20 penetrates the curved groove 22. At the same time, the journal 20 slideably engages into the link 27 at a right angle to the longitudinal direction 26, as shown in FIG. 2. In a closed position of the hand lever 21, as shown in FIGS. 1 and 5, the center 28 of the journal 20 and the rotational axis 21*d* of the hand lever 21 lie in a line along the longitudinal direction 26. The curved groove 22 forms a recess in the transverse carrier 8, so as to create a passage for the journal 20. The rotational axis 11*a* of the forward motion device 11 is rotatably mounted on another journal arranged in the transverse carrier 8. A further guide is constituted by a link 27 of the cam plate 19.

A guide cam 19*a* is attached to the cam plate 19, in addition to a projection 24, such as a rib. A corresponding recess 25 is configured in the exchangeable tank housing 4*b* and is engageable by the projection 24 so that the position of the exchangeable tank 4 is more precisely determined.

Figure 5:
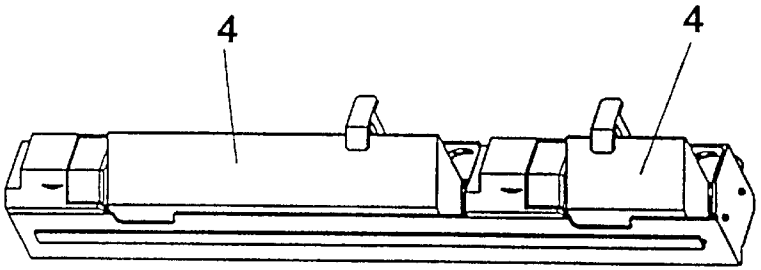
FIG. 5 is an overall perspective view of the transverse carrier, shown with the two inserted exchangeable tanks.

The hand lever 21, at a grip end 21*a*, has a cross-piece 21*b* with a covering part 21*c* that runs at a slant, so that the hand lever 21, in a closed position, extends over the exchangeable tank housing 4*b*, as shown in FIGS. 1 and 5.

Figure 6B:
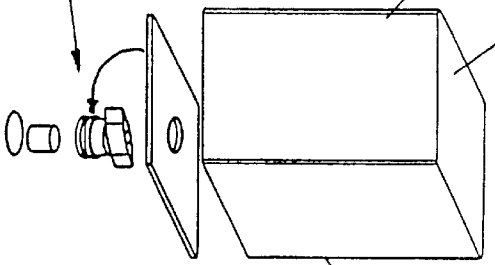
FIG. 6*b* is a perspective view of the smaller exchangeable tank, shown with a valve for the smaller exchangeable tank.
Figure 6A:
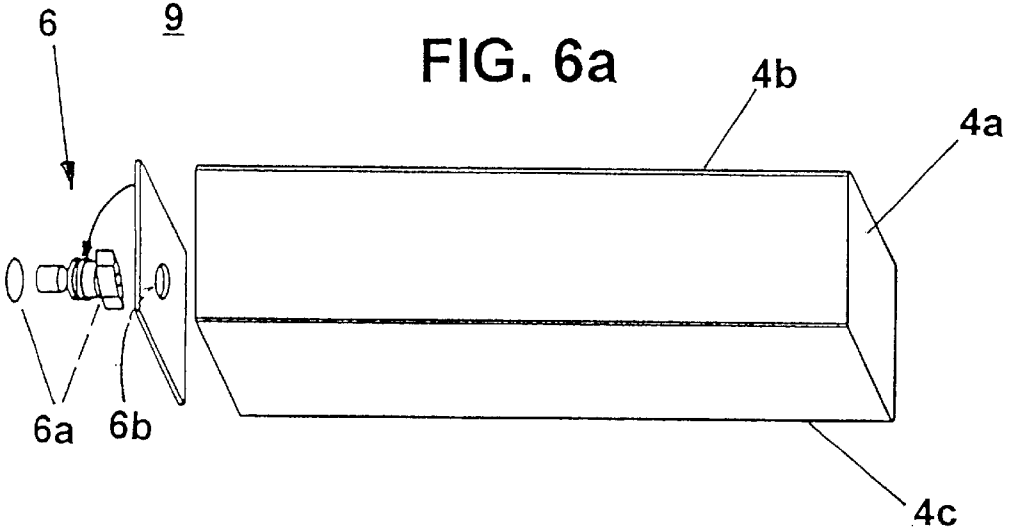
FIG. 6*a* is a perspective view of the larger exchangeable tank, shown with a valve for the larger exchangeable tank.

In FIGS. 6*a* and 6*b*, the exchangeable tank 4 having the rectangular exchangeable tank cross-section 4*a*, is closed on the side 9 having the ink connection 6, which forms the valve 6*a*. The front surface is placed between two border edges, as indicated with an arrow, so that a part of the valve 6*a* extends inward.

Figures 7A, 7B, 7C, 7D, 7E, 8A, 8B, 8C, 8D, 8E:
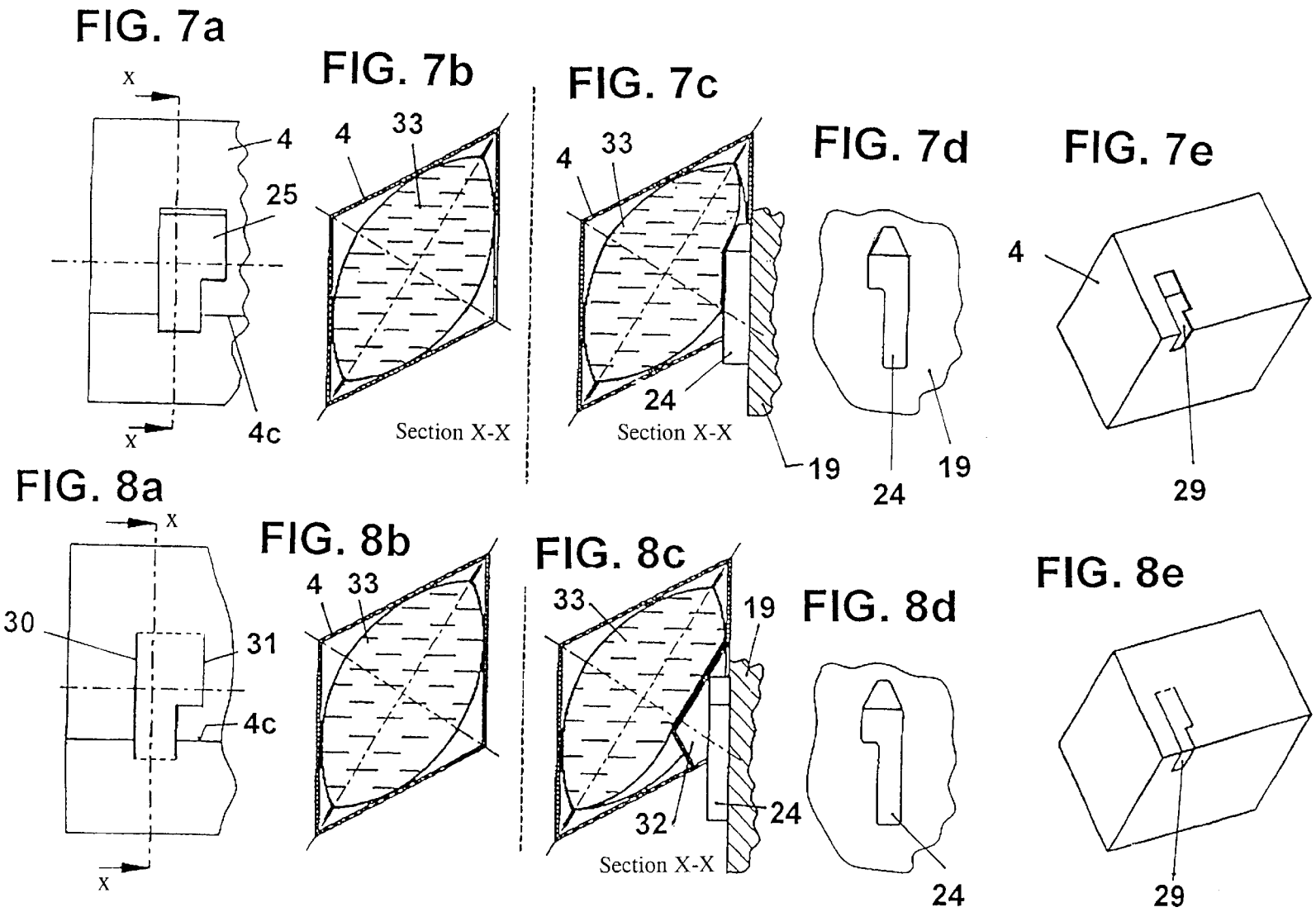
FIG. 7*a* is a view from below the exchangeable tank, showing a recess for a rib of a cam plate.
FIG. 7*b* is a cross-section through the exchangeable tank of FIG. 7*a*, shown in a state at time of delivery.
FIG. 7*c* is a cross-section through the exchangeable tank of FIG. 7*a*, shown in an assembled state upon engagement of the rib.
FIG. 7*d* is a frontal view of the rib associated with FIG. 7*c;*
FIG. 7*e* is a perspective view, showing the exchangeable tank of FIG. 7*a* in an area of an L-shaped recess for engagement of the rib.
FIG. 8*a* is a view from below the exchangeable tank as in FIG. 7*a*, showing an alternative embodiment, with straight or angular indentations on the exchangeable tank housing.
FIG. 8*b* is a cross-section through the exchangeable tank of FIG. 8*a*, shown in a state at time of delivery.
FIG. 8*c* is a cross-section through the exchangeable tank of FIG. 8*a*, with an inwardly snapped L-shaped recess.
FIG. 8*d* is a frontal view of the rib associated with FIG. 8*c*.
FIG. 8*e* is a perspective view, showing the exchangeable tank of FIG. 8*a* in an area of an L-shaped recess which folds inward.

FIGS. 7*a* through 7*e* show the corresponding recess 25 configured in the exchangeable tank 4. In one embodiment, a roughly L-shaped recess 29 is configured on the longitudinal edge 4*c* of the exchangeable tank housing 4*b*, which recess 29 corresponds to the rib 24. In the delivered state, the rib 24 is already impressed so that when the exchangeable tank 4 is placed into the ink printer, the rib 24 engages into the recess 25 and thus accurately establishes the position of the exchangeable tank 4*b*, as shown in FIGS. 7*c* and 7*d*. The L-shaped recess 25 is visible in FIG. 7*e* and shows the course over the exchangeable tank longitudinal edge 4*c*.

FIGS. 8*a* and 8*b* show a second, alternative embodiment, wherein the L-shaped recess 29 is defined by a first straight indentation 30 and a second, angular, roughly Z-shaped indentation 31. The actual recess is not created until suitable force is exerted during the insertion of the exchangeable tank 4 via the force of the rib 24. First, the first straight indentation 30 is attached to a left side of the exchangeable tank longitudinal side 4*c*, and then the second angular section 31 is attached to a right side on the exchangeable tank longitudinal side 4*c*, as shown in FIG. 8*a*. As shown in FIG. 8*d*, an angularly folded-in recess 32 is created via the rib 24 upon insertion of the exchangeable tank 4 as shown in FIGS. 8*b* and 8*c*. In FIGS. 8*b* and 8*c*, the delivery state of the exchangeable tank 4 with an ink bag 33 in the interior is presumed. In the delivered state, the L-shaped recess 29, as shown in FIG. 8*e*, is still aligned with the outer surface of the exchangeable tank housing 4*b*.

The invention is not limited by the embodiments described above which are presented as examples only but can be modified in various ways within the scope of protection defined in the appended patent claims.

We claim:

1. An ink printer comprising:

a printer body having two side walls arranged at a longitudinal distance from one another and a user side defined along a longitudinal side of the printer body between the two side walls;

an exchangeable tank removably insertable into the printer body;

a printer ink connection arranged at the printer body, an ink connection arranged at a side of the exchangeable tank, the tank side having a defined cross-section, the printer ink connection and the tank ink connection being arranged so as to be connectable to one another after insertion of the exchangeable tank into the printer body;

a basin-type transverse carrier arranged longitudinally between the two side walls proximal the user side, the basin-type transverse carrier having an open top portion that accommodates said exchangeable tank;

a spring-mounted protective plate arranged in and perpendicular to the basin-type transverse carrier so as to be longitudinally movable, a cross-section of the spring-mounted protective plate being configured so as to conform to and thereby accommodate the cross-section of the ink connection side of the exchangeable tank;

a forward motion device arranged in the basin-type transverse carrier so as to enable manual movement of the exchangeable tank into a fixed end position, thereby connecting the printer ink connection to the tank ink connection;

a shield plate arranged proximal a region of the spring-mounted protective plate so as to cover a top of the transverse carrier; and a hollow needle securely attached to the shield plate, central relative to the ink connection of the exchangeable tank.

2. The ink printer according to claim 1, further comprising;

pump means for propelling ink;and a connecting line having a first end attached to the pump means and a second end connected to the hollow needle.

3. The ink printer according to claim 2, wherein the protective plate is externally formed so as to be movable over the shield plate and the hollow needle as a cover.

4. The ink printer according to claim 2, further comprising two guide rods longitudinally extending from the shield plate toward the spring-mounted protective plate; and two compression springs respectively placed over the two guide rods, the spring-mounted protective plate being arranged so as to be guided and springably mounted in the shield plate by the two guide rods.

5. The ink printer according to claim 2, further comprising:

a pump plate mounted to the pump, the pump plate, the hollow needle, the spring-mounted protective plate and the shield plate forming a component group; and the exchangeable tank having a valve connected so as to control discharge of the ink, an opening being configured in the spring-mounted protective plate, through which opening the hollow needle penetrates into the valve.

6. The ink printer according to claim 5, wherein the connecting line is arranged so as to enable an expansion of the component group.

7. The ink printer according to claim 5, wherein a bowl-like depression is configured on a front side of the spring-mounted protective plate facing the exchangeable tank, the exchangeable tank having a housing through which a part of the valve protrudes, the bowl-like depression being slightly larger than the protruding part of the valve.

8. The ink printer according to claim 1, wherein the forward motion device includes a longitudinally movable cam plate arranged in the transverse carrier, and a hand lever having a journal pivotally attached to the cam plate so that pivoting of the hand lever between an open position and a closed position moves the cam plate forward.

9. The ink printer according to claim 8, wherein a slot-like link is configured in the cam plate perpendicular to the longitudinal direction, the journal of the hand lever being engageable in the slot-like link.

10. The ink printer according to claim 8, wherein in the closed position of the hand lever a center of the journal and a rotational axis of the hand lever lie in a line along the longitudinal direction of the cam plate.

11. The ink printer according to claim 8, wherein a projection is arranged on the cam plate so as to engage into a corresponding recess configured in the housing of the exchangeable tank.

12. The ink printer according to claim 8, wherein the hand lever has a grip end at which is arranged a cross-piece with a slanted covering part that in the closed position of the hand lever extends over the housing of the exchangeable tank.

13. The ink printer according to claim 11, wherein the corresponding recess is configured at a longitudinal edge of the housing of the exchangeable tank as a roughly L-shaped recess into which the projection of the cam plate engages.

14. The ink printer according to claim 11, wherein the exchangeable tank, on a longitudinal edge located in the transverse carrier, has a straight indentation running at a right angle to the longitudinal edge, as well as a second, angular indentation running parallel to the straight indentation so that upon exertion of an external force upon insertion of the exchangeable tank an angularly folded-in recess is pressed inward into the exchangeable tank by the cam plate.

* * * * *